US008082927B2

(12) United States Patent
Bonge

(10) Patent No.: US 8,082,927 B2
(45) Date of Patent: Dec. 27, 2011

(54) ADJUSTABLE FACIAL SHAVING GUIDE

(76) Inventor: Scott Bonge, Hot Springs, AR (US)

( * ) Notice: Subject to any disclaimer, the term of this patent is extended or adjusted under 35 U.S.C. 154(b) by 961 days.

(21) Appl. No.: 11/969,777

(22) Filed: Jan. 4, 2008

(65) Prior Publication Data

US 2009/0173357 A1 Jul. 9, 2009

(51) Int. Cl.
*A45D 24/36* (2006.01)

(52) U.S. Cl. ..... 132/214

(58) Field of Classification Search ..... 132/211–215, 132/319, 276–280, 273, 200, 206; 433/6, 433/140, 93, 73; 33/511, 513–514; 128/859; 30/37, 30–31, 77, 537, 346
See application file for complete search history.

(56) References Cited

U.S. PATENT DOCUMENTS

| | | | | | |
|---|---|---|---|---|---|
| 1,633,978 | A * | 6/1927 | Calmels | ..... | 132/214 |
| 2,804,684 | A | 9/1957 | Talamonti | | |
| 3,858,589 | A | 1/1975 | Geiger | | |
| 3,870,055 | A * | 3/1975 | Barbarow | ..... | 132/215 |
| 4,277,237 | A * | 7/1981 | Dermer | ..... | 433/72 |
| 4,616,998 | A * | 10/1986 | Wong | ..... | 433/73 |
| D381,462 | S | 7/1997 | Bailey | | |
| 6,655,389 | B2 * | 12/2003 | Bertucci | ..... | 132/214 |
| 2003/0116172 | A1 | 6/2003 | Berucci | | |
| 2004/0074511 | A1 | 4/2004 | Sussan | | |

* cited by examiner

*Primary Examiner* — Todd Manahan
*Assistant Examiner* — Brianne O'Neill
(74) *Attorney, Agent, or Firm* — QuickPatents, Inc.; Kevin Prince

(57) ABSTRACT

A guide for trimming the beard of a person with a razor is disclosed. A mouth piece has a proximal end adapted for gripping with a mouth of the person, and a distal end. A rigid base is fixed at a proximal side thereof to the distal end of the mouth piece. The base further comprises a distal side, at least one peripheral edge connecting the proximal side, and in one embodiment at least one guide adjustment means. A pair of guide members each have a continuous outer side, an inner side, and at least one peripheral edge connecting the outer and inner sides. Each guide member further includes at least one adjustment post engaged with the at least one guide adjustment means of the base. The guide adjustment means is adapted to adjust the lateral position of each guide member with respect to the base. With the mouth piece held by the mouth of the person, the at least one guide adjustment means of the base may be actuated to adjust the lateral position of each guide member to a desired location on a face of the person. The person is then able to trim the beard with the razor only on the areas of the face not shielded by the guide.

6 Claims, 3 Drawing Sheets

ADJUSTABLE FACIAL SHAVING GUIDE

CROSS-REFERENCE TO RELATED APPLICATIONS

Not Applicable.

STATEMENT REGARDING FEDERALLY SPONSORED RESEARCH AND DEVELOPMENT

Not Applicable.

FIELD OF THE INVENTION

This invention relates to razors, and more particularly to a guide for shaping a man's goatee with a razor or electric shaver.

DISCUSSION OF RELATED ART

Numerous innovations for hair trimming devices have been provided in the prior art that will be described. Even though these innovations may be suitable for the specific individual purposes to which they address, they differ from the present invention in significant ways as will be discussed.

A first example, U.S. Pat. No. 3,858,589, issued on Jan. 7, 1975, to Geiger teaches a set of tonsorial implements for maintaining the sideburns and moustache in a neat and attractive shape; the implements consisting of separate tools each one of which is designed to be used as a template for placement either over a sideburn or a moustache so that a person can trim hair or whiskers projecting beyond the template edge; the templates each accordingly being specifically shaped and sized for a particular style of sideburn or moustache. One drawback with this type of hair trimming device is that it is not adjustable to a beard of a person, and it does not easily allow a person to easily hold the template in place without blocking the person's view in a mirror, for example.

A second example, U.S. Pat. No. 3,870,055, issued on Mar. 11, 1975, to Barbarow teaches a device for providing an outline pattern for styling a person's mustache that includes a template, a clamping arrangement receivable within the mouth of the person whose mustache is to be styled, and a member coupling the template with the clamping arrangement to locate and hold the template against the person's upper lip in response to reception of the clamping arrangement in the mouth and application of clamping pressure by the mouth upon the clamping arrangement. This type of hair trimming device is also not easily adjustable to the specific facial hair pattern of the user.

A third example, U.S. Pat. No. 6,655,389, issued on Dec. 2, 2003, to Bertucci, teaches a device for styling hair comprising a pair of side walls, a top support member connected to the side walls, and a bottom support member connected to the pair of side walls. The device also includes an intermediate support member connected to the pair of side walls between the top support member and the bottom support member to form an upper opening between the top support member and the intermediate support member and to form a lower opening between the bottom support member and the intermediate support member. A method for styling a goatee comprising the steps of providing a device having an upper opening and lower opening, positioning lips in the upper opening and a chin including a goatee in the lower opening, and trimming an area around the goatee as desired. This type of hair trimming device is also not adjustable to a beard of the user, and cannot be easily held by the user without blocking his view in a mirror, for example.

A fourth example, U.S. Document 20040074511, published on Apr. 22, 2004, to Sussan teaches a guide to trim and shave facial hair that is held in place by a chin plate and releasable neck strap holding the plate tight on the chin. The guide has a pair of clamps rotatably connected to the chin plate, each clamp having an aperture slidably receiving a calibrated guide rod, the clamp being capable of securing the rod at a variable distance from the chin plate. A second embodiment has an additional pair of guide rods slidably and rotatably attached to the first pair of guide rods by a second pair of clamps. The second pair of guide rods extends from the first pair of rods at a variable distance from the chin plate and can be rotated in parallel planes with the first pair of rods about the axis of the second clamp. This type of device is difficult to use and adjust to the user, and further is overly complicated and therefore expensive to manufacture.

It is apparent now that numerous innovations for hair trimming devices have been provided in the prior art that are adequate for various purposes. Furthermore, even though these innovations may be suitable for the specific individual purposes to which they address, accordingly, they would not be suitable for the purposes of the present invention as heretofore described.

None of the aforementioned prior art hair trimming devices teaches an adjustable facial shaving guide that is adjustable to a beard of a person, so that the beard of the person can be trimmed with a razor not shielded by the guide. The present invention accomplishes this objective.

SUMMARY OF THE INVENTION

An object of the present invention is to provide an adjustable facial shaving guide that avoids the disadvantages of the prior art.

Another object of the present invention is to provide an adjustable facial shaving guide that is simple and inexpensive to manufacture.

Still another object of the present invention is to provide an adjustable facial shaving guide that is simple to use.

Briefly stated, still yet another object of the present invention is to provide an adjustable facial shaving guide for trimming the beard of a person with a razor, comprising a mouth piece having a proximal end adapted for gripping with a mouth of the person, and a distal end. A rigid base is fixed at a proximal side to the distal end of the mouth piece. The base further comprises a distal side, at least one peripheral edge connecting the proximal side, and at least one guide adjustment means. A pair of guide members each have a continuous outer side, an inner side, and at least one peripheral edge connecting the outer and inner sides. Each guide member further preferably includes at least one adjustment post engaged with the at least one guide adjustment means of the base. The guide adjustment means, in an adjustable embodiment, is adapted to adjust the lateral position of each guide member with respect to the base. With the mouth piece held by the mouth of the person, the at least one guide adjustment means of the base may be actuated to adjust the lateral position of each guide member to a desired location on a face of the person, the person is able then to trim the beard with the razor only on the areas of the face of the person not shielded by the guide.

The novel features which are considered characteristic of the present invention are set forth in the appended claims. The invention itself, however, both as to its construction and its method of operation, together with additional objects and advantages thereof, will be best understood from the following description of the specific embodiments when rear and understood in connection with the accompanying drawing.

DETAILED DESCRIPTION OF THE PREFERRED EMBODIMENT

Figure 1:
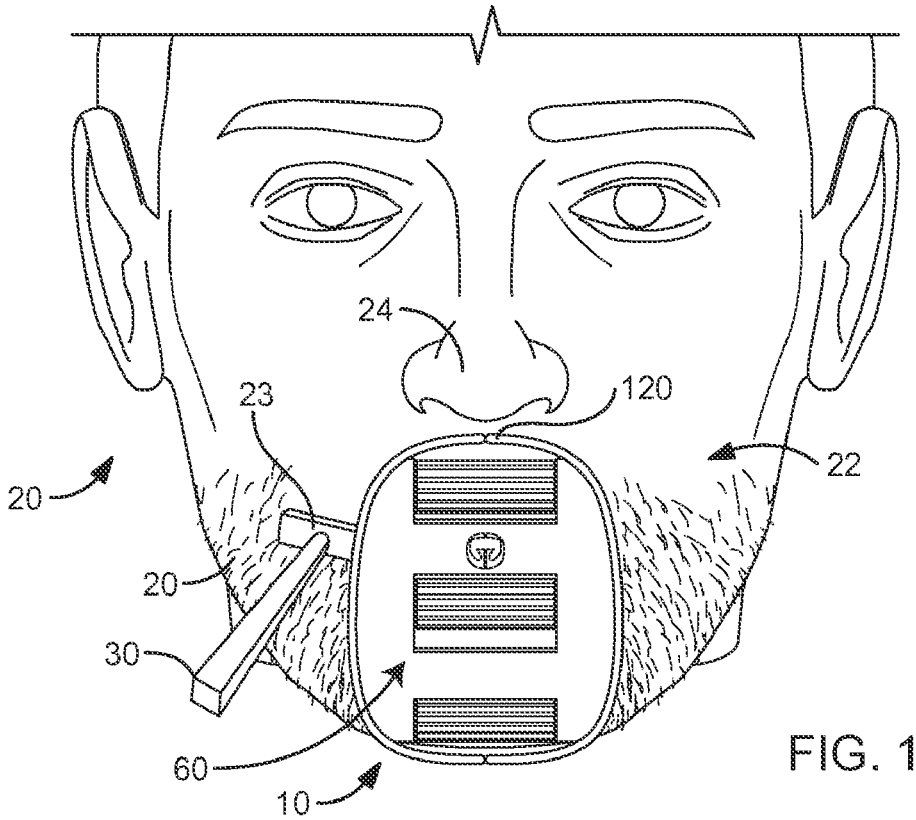
FIG. 1 is a front elevational view of one embodiment of the present invention in an operative position.
Figure 2:
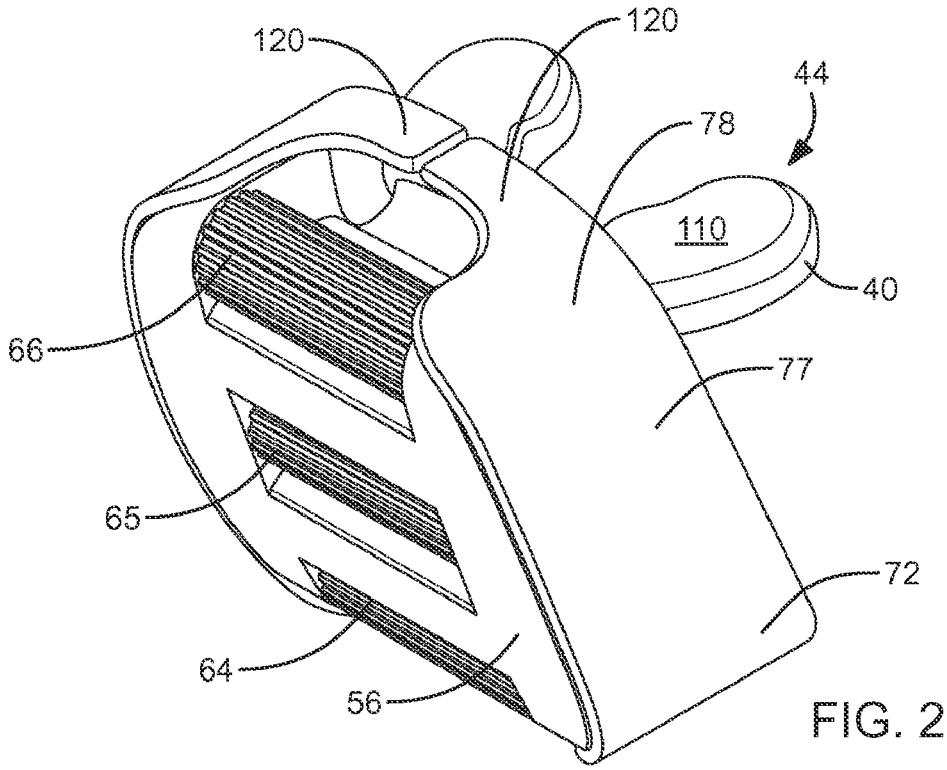
FIG. 2 is a front perspective view of the present invention.
Figure 3:
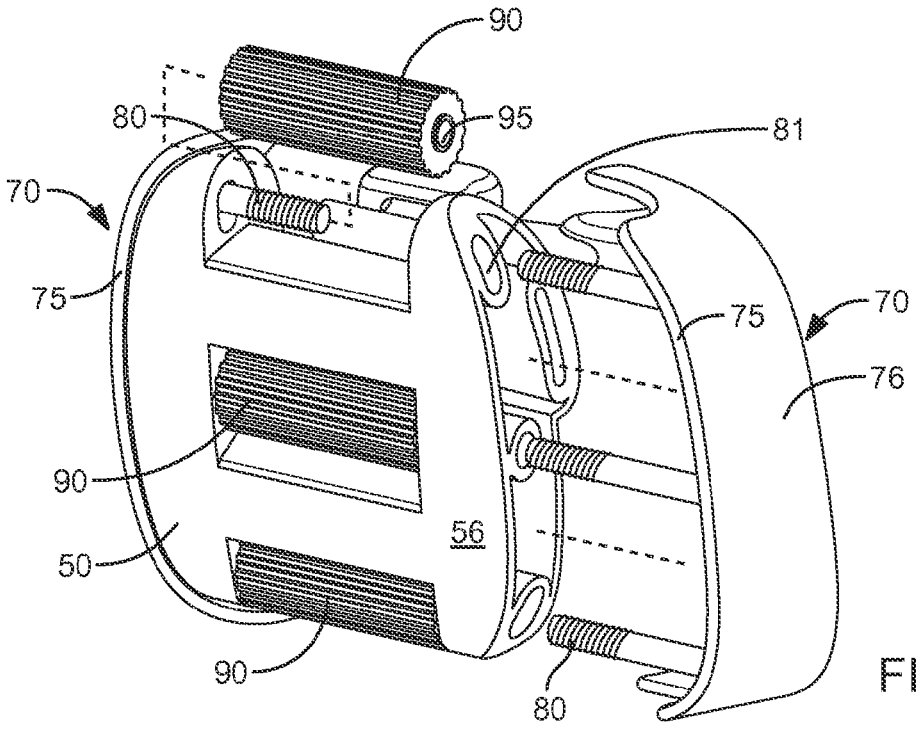
FIG. 3 is an exploded perspective view of the present invention, taken generally from a front side thereof.
Figure 4:
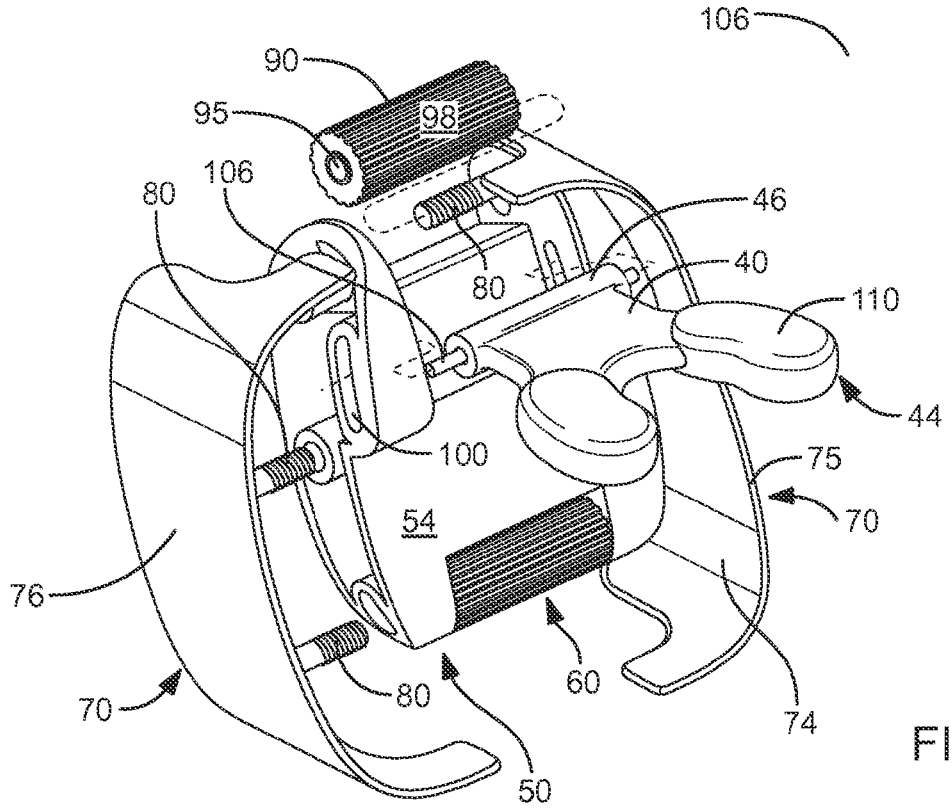
FIG. 4 is an exploded perspective view of the present invention, taken generally from a rear side thereof.

Referring now to the figures, in which like numerals indicate like parts, and particularly to FIGS. 1 through 4, the present invention will be discussed with reference thereto. A guide 10 for trimming a beard 21 of a person 20 with a razor 30 is provided.

The guide 10 comprises a mouth piece 40 having a proximal end 44 adapted for gripping with a mouth 22 of the person 30 and a distal end 46. A rigid base 50 is fixed at a proximal side 54 to the distal end 46 of the mouth piece 40. The base 50 further comprises a distal side 56, at least one peripheral edge 55 connecting the proximal side 54, and, in an adjustable embodiment, at least one guide adjustment means 60.

A pair of guide members 70 each have a continuous outer side 76, an inner side 74, and at least one peripheral edge 75 connecting the outer and inner sides 76, 74. In the simplest embodiment of the invention (FIGS. 5-7), the inner side 74 of each guide member 70 is fixed to the peripheral edge 55 of the rigid base 50. In an adjustable embodiment of the invention, as illustrated in the other figures, each guide member 70 further includes at least one adjustment post 80 that extends through an aperture 81 in the base 50 to engage with the at least one guide adjustment means 60 of the base 50. The guide adjustment means 60 is adapted to adjust the lateral position of each guide member 70 with respect to the base 50.

With the mouth piece 40 held by the mouth 22 of the person 20, the at least one guide adjustment means 60 of the base 50 may be actuated to adjust the lateral position of each guide member 70 to a desired location on face 23 of the person's 20. The person 20 is able then to trim the beard 21 with the razor 30 only on the areas of the face 23 of the person 20 not shielded by the guide 10.

The base 50 may include both an upper guide adjustment means 66 and a lower guide adjustment means 64, such that the distance between an upper portion 78 of each guide member 70 may be different than the distance between a lower portion 72 of each guide member 70. Each guide adjustment means 66, 64 is preferably an elongated turnbuckle 90 having a threaded internal and longitudinal aperture 95 therein. The adjustment post 80 of each guide member 70 is oppositely-threaded, such that rotation of the turnbuckle 90 in one direction causes each post 80 to move laterally away from the turnbuckle 90, and rotation of the turnbuckle 90 in the opposite direction causes each post 80 to move laterally toward the turnbuckle 90. Each turnbuckle 90 includes an outer surface 98 adapted for positive frictional engagement with a finger of the person 20.

The base 50 may further include a middle guide adjustment means 65, and wherein each guide member 70 is pliable, such that the distance between the upper portion 78, a middle portion 77, and the lower portion 72 of each guide member 70 may be at least somewhat independently adjusted.

The base 50 further preferably includes a vertical adjustment means 100 engaged to a shaft 106 of the distal end 46 of the mouth piece 40, such that the mouth piece 40 may be both pivoted and moved vertically with respect to the base 50, thereby allowing the user to adjust the relative position between the mouth piece 40 and the base 50. The mouth piece 40 may also include a cushioning outer layer 110, and may terminate in a U-shaped proximal end 44 to facilitate holding thereof by the mouth 23 of the person 20. The top portion of each guide member 70 may include a centering guide 120 for facilitating the centering of the guide 10 on the face 23 of the person 20 by aligning each centering guide 120 symmetrically with a nose 24 of the person 20.

Figure 5:
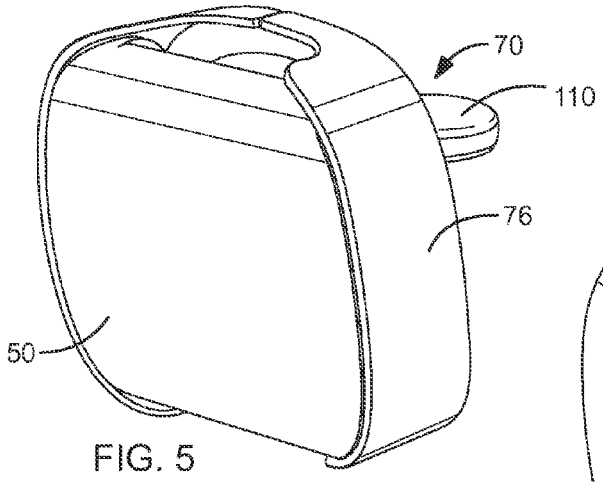
FIG. 5 is a perspective view of a simplified embodiment of the present invention.
Figure 6:
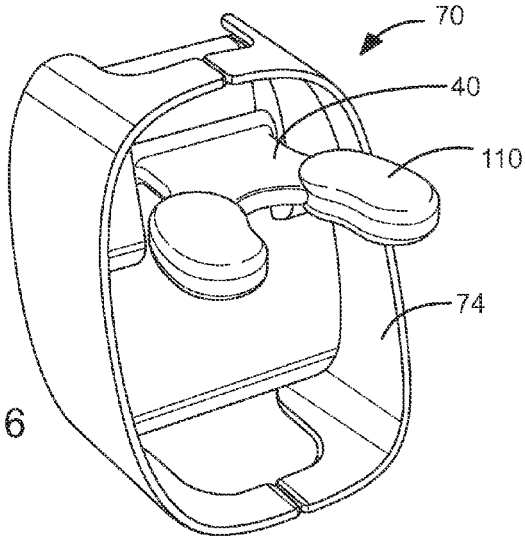
FIG. 6 is a perspective view of the embodiment of FIG. 5, taken generally from a rear side thereof.
Figure 7:
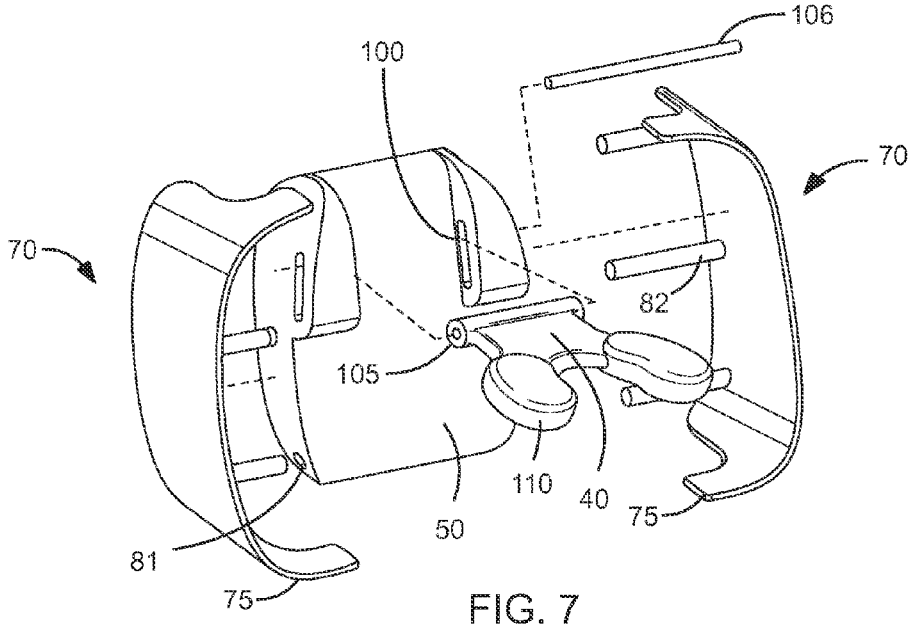
FIG. 7 is an exploded perspective view of the embodiment of FIG. 5, taken generally from a rear side thereof.

In the simplest embodiment of the invention, illustrated in FIGS. 5-7, each guide member 70 is fixed with respect to the base 50. Connector rods 82 are included for fixing the inner surface 74 of each guide member 70 to the base 50, as illustrated, but the inner surface 74 of each guide member may also be ultrasonically welded, adhered, or otherwise fixedly attached to the base 50. In such an embodiment, the lateral position of each guide member 70 is fixed with respect to the base 50, and so guides 10 having different sizes and shapes may be made to suit each individual person 20 (FIGS. 5 and 6).

It will be understood that each of the elements described above, or two or more together, may also find a useful application in other types of constructions differing from the type described above. While the invention has been illustrated and described as embodiments of an adjustable facial shaving guide, accordingly it is not limited to the details shown, since it will be understood that various omissions, modifications, substitutions and changes in the form and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

What is claimed is:

1. A guide for trimming the beard of a person with a razor, comprising:

a mouth piece having a proximal end adapted for gripping with a mouth of the person, and a distal end;

a rigid base fixed at a proximal side to the distal end of the mouth piece, the base further comprising a distal side, at least one peripheral edge connecting the proximal side to the distal side, and at least one guide adjustment means, wherein the at least one peripheral edge is adapted to cover at least a portion of a chin of the person when the mouth piece is gripped with the mouth of the person;

a pair of guide members each having a continuous outer side, an inner side, and at least one peripheral edge connecting the outer and inner sides, each guide further including at least one adjustment post engaged with the at least one guide adjustment means of the base, the guide adjustment means adapted to adjust the lateral position of each guide member with respect to the base;

each guide adjustment means is an elongated turnbuckle having a threaded internal and longitudinal aperture therein, and wherein the adjustment post of each guide member is oppositely-threaded, such that rotation of the turnbuckle in one direction causes each post to move laterally away from the turnbuckle, and rotation of the turnbuckle in the opposite direction causes each post to move laterally toward the turnbuckle;

whereby with the mouth piece held, by the mouth, the at least one guide adjustment means of the base may be actuated to adjust the lateral position of each guide member to a desired location on the person's face, the person able then to trim the beard with the razor only on the areas of the person's face not shielded by the guide.

2. The guide of claim 1 wherein the turnbuckle includes an outer surface adapted, for positive frictional engagement with a person's finger.

3. A guide for trimming the beard of a person with a razor, comprising:

a mouth piece having a proximal end adapted for gripping with a mouth of the person, and a distal end;

a rigid base fixed at a proximal side to the distal end of the mouth piece, the base further comprising a distal side, at least one peripheral edge connecting the proximal side to the distal side, and at least one guide adjustment means;

a pair of guide members each having a continuous outer side, an inner side, and at least one peripheral edge connecting the outer and inner sides, each guide further including at least one adjustment post engaged with the at least one guide adjustment means of the base, the guide adjustment means adapted to adjust the lateral position of each guide member with respect to the base;

whereby with the mouth piece held, by the mouth, the at least one guide adjustment means of the base may be actuated to adjust the lateral position of each guide member to a desired, location on the person's face, the person able then to trim the beard with the razor only on the areas of the person's face not shielded by the guide, wherein the base includes an upper guide adjustment means and a lower guide adjustment means, such that the distance between an upper portion of each guide member may be different than the distance between a lower portion of each guide member; and the base further includes a middle guide adjustment means, and wherein each guide member is pliable, such that the distances between the upper portion, a middle portion, and the lower portion of each guide member may be independently adjusted.

4. The guide of claim 3 wherein the base further includes a vertical adjustment means engaged to the distal end of the mouth piece, such that the mouth piece may be both pivoted and moved vertically with respect to the base.

5. A guide for trimming the beard of a person with a razor, comprising:

a mouth piece having a proximal end adapted for gripping with a mouth of the person, and a distal end;

a rigid base fixed at a proximal side to the distal end of the mouth piece, the base further comprising a distal side, at least one peripheral edge connecting the proximal side to the distal side, and at least one guide adjustment means, wherein the at least one peripheral edge is adapted to cover at least a portion of a chin of the person when the mouth piece is gripped with the mouth of the person;

a pair of guide members each having a continuous outer side, an inner side, and at least one peripheral edge connecting the outer and inner sides, each guide further including at least one adjustment post engaged with the at least one guide adjustment means of the base, the guide adjustment means adapted to adjust the lateral position of each guide member with respect to the base;

the base including an upper guide adjustment means and a lower guide adjustment means, such that the distance between an upper portion of each guide member may be different than the distance between a lower portion of each guide member;

the base further including a middle guide adjustment means, and wherein each guide member is pliable, such that the distances between the upper portion, a middle portion, and the lower portion of each guide member may be independently adjusted;

whereby with the mouth piece held, by the mouth, the at least one guide adjustment means of the base may be actuated to adjust the lateral position of each guide member to a desired location on the person's face, the person able then to trim the beard with the razor only on the areas of the person's face not shielded by the guide.

6. The guide of claim 5 wherein the base further includes a vertical adjustment means engaged to the distal end of the mouth piece, such that the mouth piece may be both pivoted and moved vertically with respect to the base.

* * * * *